United States Patent [19]

van Lieshout

[11] 4,270,584

[45] Jun. 2, 1981

[54] PROCESS FOR SUPPLYING BEVERAGES

[75] Inventor: Marinus W. van Lieshout, Made, Netherlands

[73] Assignee: Skol Brouwerijen N.V., Breda, Netherlands

[21] Appl. No.: 82,943

[22] Filed: Oct. 9, 1979

Related U.S. Application Data

[63] Continuation of Ser. No. 881,505, Feb. 27, 1978, abandoned.

[30] Foreign Application Priority Data

Feb. 25, 1977 [NL] Netherlands ..... 7702042

[51] Int. Cl.[3] ..... B65B 3/22

[52] U.S. Cl. ..... 141/11; 141/82; 141/237

[58] Field of Search ..... 141/1-12, 141/82, 129-191, 236-248; 62/141, 188, 389, 390; 222/201, 1, 394, 146 C; 53/79, 127, 281, 282

[56] References Cited

U.S. PATENT DOCUMENTS

| | | | |
|---|---|---|---|
| 4,011,896 | 3/1977 | Nilon et al. | 141/82 |
| 4,094,445 | 6/1978 | Bevan | 222/146 C |
| 4,144,914 | 3/1979 | Nilon et al. | 141/82 |

*Primary Examiner*—Houston S. Bell, Jr.

*Attorney, Agent, or Firm*—Becker & Becker, Inc.

[57] ABSTRACT

The invention concerns a method and an apparatus for continuously filling and dispensing large numbers of cups with beverages, such as beer. The cups are positioned in rows in suitable containers and conducted underneath dispensing nozzles likewise arranged in a row, the dispensing direction of which may be adjustable.

1 Claim, 2 Drawing Figures

PROCESS FOR SUPPLYING BEVERAGES

This is a straight continuation application of copending application Ser. No. 881,505-van Lieshout filed Feb. 27, 1978, now abandoned.

The retail sale of beverages takes place in general in bottles of different size, while tinned beverages are also customary at present.

The increasing vandalism and behavior of spectators in stadiums where sports events take place have resulted in the prohibition of packings of beverages as mentioned above.

In order to remove the above objections, the present invention provides a process for retail supply of beverages in receptacles that are unsuitable to be thrown to other people or otherwise may result in injuries.

According to the invention the beverage is dispensed in a plastic cup or the like receptacle advanced in rows of a specific number of pieces underneath a corresponding number of nozzles.

Although not restricted thereto, it is the object of the invention to dispense beer in the above mentioned form. It is thus possible in a very short period of time to meet the demand of large numbers of units.

A further substantial advantage of the new process is that the beer can be tapped directly from the keg. It is well known that the taste of beer dispensed in this manner is better than that of beer which is bottled or tinned.

The technique in the manufacturing of plastic receptacles has been so developed that the cups to be used in the new process cannot or hardly be distinguished from the conventional beer glasses. The weight is considerably less so that such a "glass" cannot easily be used as a throwing weapon or may otherwise cause injuries.

When applying the new process, containers may be used that are suitable for receiving one or more rows of receptacles, which containers are then advanced underneath the nozzles. In the simplest form, the nozzles can be arranged above a platform over which the receptacles are moved underneath the nozzles. The receptacles, in the present case plastic cups, can be moved close together over the platform. It will then not be necessary to close the tap after filling a row. The loss of beverage is negligible.

As already observed, it is the object to tap the beer directly from the keg. As soon as a keg is empty, it is possible to start a full keg within a few seconds through application of a suitable connection. Here too the loss of beverage is minimal.

When beer is introduced at a specific angle in receptacles, there is produced the required froth collar, naturally when the proper temperature and pressure are maintained. The latter condition can be simply met. The above mentioned angle can be obtained by either making the nozzles adjustable or selecting the place of supply adjacent the wall of the receptacle. Instead of a platform for moving the rows of receptacles underneath the nozzles, the transport surface might be formed by the top part of an endless conveyor belt. The transport speed should then be adapted to the speed, the time respectively within which a glass can be filled.

The apparatus by means of which the new process can be performed is of a simple construction and may be designed inexpensively.

The new apparatus substantially comprises a platform provided with upright longitudinal edges, above which there is mounted a transversely oriented multiple nozzle.

Further particulars of the invention will now be discussed by way of example with reference to the diagrammatic drawing in which.

Figure 1:
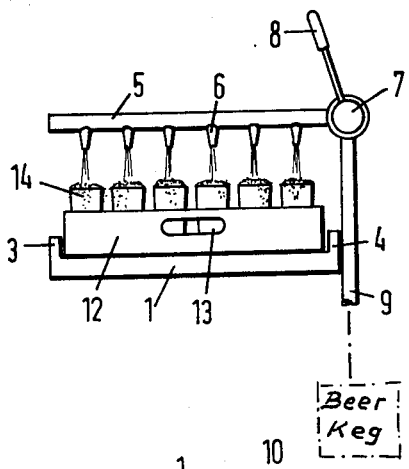
FIG. 1 shows a side view of an apparatus according to the invention.
Figure 2:
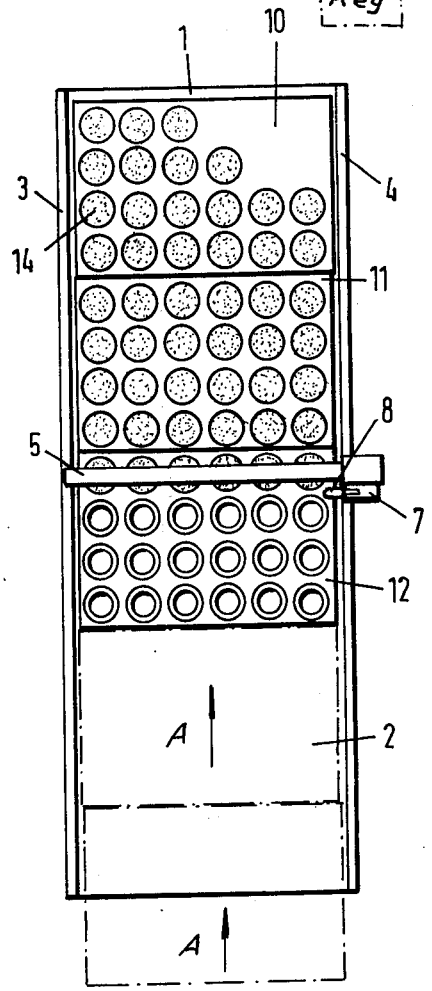
FIG. 2 shows a top view thereof.

By 1 is indicated a platform the top face 2 of which is smooth.

The platform 1 is provided with upright edges 3 and 4. Above platform 1 there is present a manifold 5 having a plurality of outlet openings, one of which being indicated by 6. By 7 is indicated a valve which is operable by a handle 8.

The supply line to the manifold 5 is numbered 9. As shown in the drawing, a plurality of containers 10, 11 and 12 is disposed on platform 1. These containers are suitable for receiving and holding drinking receptacles arranged in rows. The number of cups arranged in rows, in this case made of plastic, which are similar as regards shape and aspect to a normal glass, corresponds to the number of outlet openings 6 in the manifold 5. Twenty-four cups may be received per each container 10, 11 and 12. This number may naturally vary. As container are used initially flat boxes which are unfolded at the tapping location. Each container may be provided with handles 13 or the like for facilitating the transport of the respective container.

The top face 2 of the platform 1 might be designed as the top part of a conveyor belt.

The apparatus according to the invention is adapted for retail dispensing beverages, for instance beer, which has the considerable advantage that the beer can be tapped in fresh condition, the taste of which is better than of beer from glasses, bottles or tins. The dispensing is effected per cup having a low weight. The importance thereof has been already discussed in the above in connection with the application of the invention, for instance in stadiums.

The apparatus is operated as follows:

The supply line 9 is connected to a beer keg. Valve 7 is opened and the beer now flows continuously via the nozzles 6 into the cups 14 present thereunder in containers. Said containers are pushed forward in the direction of the arrows A as soon as a row of cups 14 is filled. It will be clear that in this manner a large quantity of beverages can be tapped in a short period of time. During the advancement of the containers 10, 11 and 12, the nozzles 6 continue to dispense beverage but the resulting loss is negligible. Instead of in straight rows, the cups in each row may also be arranged in offset relationship, so that the container could be slightly smaller.

As already stated, the top face 2 of the platform 1 might also be designed as the top part of an endless conveyor belt. The motion rhythm is then adapted to the time required to fill a row of cups.

Although not shown, the nozzles are either inclined or they are disposed adjacent the wall of the drinking receptacle to be filled, so as to form the required froth collar during beer tapping. The nozzles may be adjustable.

After a keg has been emptied, the next may be tapped. To this end, there are provided quick-acting couplings which enable this operation to be carried out in a few seconds, so that the tapping need hardly be interrupted. Instead of moving the cups 14 in containers 10, 11 or 12 underneath nozzles 6, it is naturally also possible to arrange the drinking receptacles in rows while pushing same underneath the nozzles.

What I claim is:

1. The process for dispensing beverages by beverage tapping directly from a keg under pressure into open cups for better taste and retaining of foam, comprising in combination the steps of arranging said cups in a plurality of rows in each of a plurality of containers, the containers being movable closely together transversely of said rows along a transporting surface formed by a top part of an endless conveyor belt, dispensing a beverage continuously from a plurality of nozzles in a row above said cups, said nozzles corresponding in number to the number of cups in each row, each nozzle being positioned above an open cup in a row, said cups in each row being closely adjacent cups in successive rows, continuously moving said containers and cups transversely of said rows to position the cups of each row under the row of nozzles, opening a manually operated beverage tapping valve controlling the flow of beverage to all said nozzles simultaneously by way of a projecting cantilever manifold without need to close the tap valve after filling all cups in a row and continuously dispensing a beverage under pressure from said row of nozzles and progressively moving said row of cups in said plurality of containers successively under said continuously dispensing nozzles to dispense said beverage, maintaining the dispensing direction adjustment and thereby dispensing said beverage from each nozzle against the wall of each cup, so that said rows of cups are filled successively as said containers with said rows of cups are moved under said nozzles with only negligible loss of beverage and with said beverage consequently retaining required froth collar of foam in the cups during beverage tapping by maintaining proper temperature and pressure of the beverage during said continuous dispensing of the beverage.

* * * * *